United States Patent [19]

Wright

[11] Patent Number: 4,734,945

[45] Date of Patent: Apr. 5, 1988

[54] TILT MECHANISM FOR INFANT INCUBATOR

[75] Inventor: Larry E. Wright, Baltimore, Md.

[73] Assignee: The BOC Group, Inc., Montvale, N.J.

[21] Appl. No.: 50,274

[22] Filed: May 14, 1987

[51] Int. Cl.[4] ..... A61G 11/00; A47C 20/04

[52] U.S. Cl. ..... 5/11; 128/1 B; 5/64; 5/93 R; 5/75; 248/397

[58] Field of Search ..... 5/11, 63, 64, 65, 75, 5/77, 93 R, 108; 128/1 B; 292/359; 248/396, 397

[56] References Cited

U.S. PATENT DOCUMENTS

| | | | |
|---|---|---|---|
| 869,911 | 11/1907 | Kintz | 5/77 |
| 2,632,582 | 3/1953 | Bukolt | 5/11 |
| 2,633,842 | 4/1953 | Higgs | 128/1 B |
| 2,980,106 | 4/1961 | Carlson | 128/1 B |
| 3,005,673 | 10/1961 | Smith et al. | 128/1 B |
| 3,782,362 | 1/1974 | Puzio | 128/1 B |
| 3,858,570 | 1/1975 | Beld et al. | 128/1 B |
| 4,003,378 | 1/1977 | Pickering | 128/1 B |

*Primary Examiner*—Alexander Grosz
*Assistant Examiner*—Eric K. Nicholson
*Attorney, Agent, or Firm*—Roger M. Rathbun; Larry R. Cassett

[57] ABSTRACT

A tilt mechanism is disclosed for adjusting the angle of rest of an infant contained within an infant incubator. The tilt mechanism comprises at least one bent rod that underlies the bed on which the infant is positioned. By rotating the bent rod, an offset shaped portion of the rod elevates one end of the infant bed. The rotation is effected by a handle located outside the incubator and which has a plurality of positions, each of which position is locked in place by a spring biased plunger that enters certain grooves formed in the interior surface of the handle. A push button pushes against the spring bias to move the plunger out of engagement with the grooves in the handle so that the handle can be rotated to another selected position.

4 Claims, 3 Drawing Sheets

TILT MECHANISM FOR INFANT INCUBATOR

BACKGROUND OF THE INVENTION

This invention relates to infant incubators, and more particularly to a means of adjusting the angular position of the bed or support on which the infant lies.

Infant incubators have, of course, had a variety of means to adjust the tilt angle at which the infant is positioned. In general, it is desirable that the means of adjusting the tilt position of the infant be external of the incubator so that the special environment created for the infant is not disturbed. In addition, the tilt mechanism should be capable of adjusting the tilt angle in either direction, that is, to externally place the infant in a head raised or head lowered position.

A further desirable feature is that the tilt mechanism should preferably operate with a minimum of abrupt motion to the infant so as not to startle the infant when moving to a different position. Thus, the motion needs to be carried out as smoothly as possible.

Present tilt mechanisms do operate external of the infant compartment and are adjustable by a pair of handles that can be rotated to raise or lower either end of the infant support, however, one of the difficulties with the adjustment of the present system is that no intermediate positioning is possible and a very abrupt movement is effected when the infant support is taken out of its high position.

That is, one of the present tilt mechanism provides bent rods that underlie the infant support and which are rotated to raise the rods and thus raise the infant support. At the top position, the rods are locked in position by means of a locking projection over which the rods must ride to engage and disengage the infant support from that respective top position. Therefore, to lower that end of the infant bed, from its top position considerable twisting force must be applied to the rod to override the projection. Typically, that excess force causes a rapid extremely abrupt movement downwardly when the rod has overridden the projection and the infant is startled. In addition, since there are no intermediate positions, if the adjusting handle is inadvertently released at any time intermediate the lower most position and the top position, the infant support will descend rapidly all the way down to its horizontal position, thus again stressing the infant.

SUMMARY OF THE INVENTION

There is herein described a tilt mechanism for infant incubators in which the angle of the infant's support may be varied through a plurality of positions by raising either the head or the feet of the infant.

The tilt mechanism utilizes bent rods that underlie the infant bed and are rotated to raise or lower an offset portion of the bent rods and thus raise or lower an end of the infant bed. A handle is provided with a plurality of slots at various angular positions of desired tilt of the infant. A plunger is spring loaded and biased to fit within opposite slots in the handle.

By depressing a button, the plunger can be disengaged from its particular position in the handle slots, and the handle, and thus the bent rods, rotated to another position. Releasing the button again causes the plunger to reenter opposite slots in the handle to securely lock it into the new position.

Thus, by providing a plurality of slots in the handle, the bent rods and infant bed can be placed in various desired tilt angles.

In addition, by providing a spring release mechanism, in the event the user inadvertently lets go of the handle in an intermediate position, the infant bed will only descend until the plunger is forced into the next set of slots. In such manner, the infant is not allowed to descend entirely to the bottom position but will be stopped after a relatively short descent.

Also, by locking the position of the handle with respect to its rotation, a large projection is not needed on the bottom of the infant bed at its uppermost position since the bent rod does not lock itself to the infant bed. Therefore, only a slight projection is needed to stop undesirable overswing of the bent rod and the infant can be lowered from that top position gradually and without abrupt motion.

BRIEF DESCRIPTION OF THE DRAWINGS

The invention is diagrammatically illustrated by way of example in the drawings appended hereto in which.

DESCRIPTION OF THE PREFERRED EMBODIMENT

Figure 1:
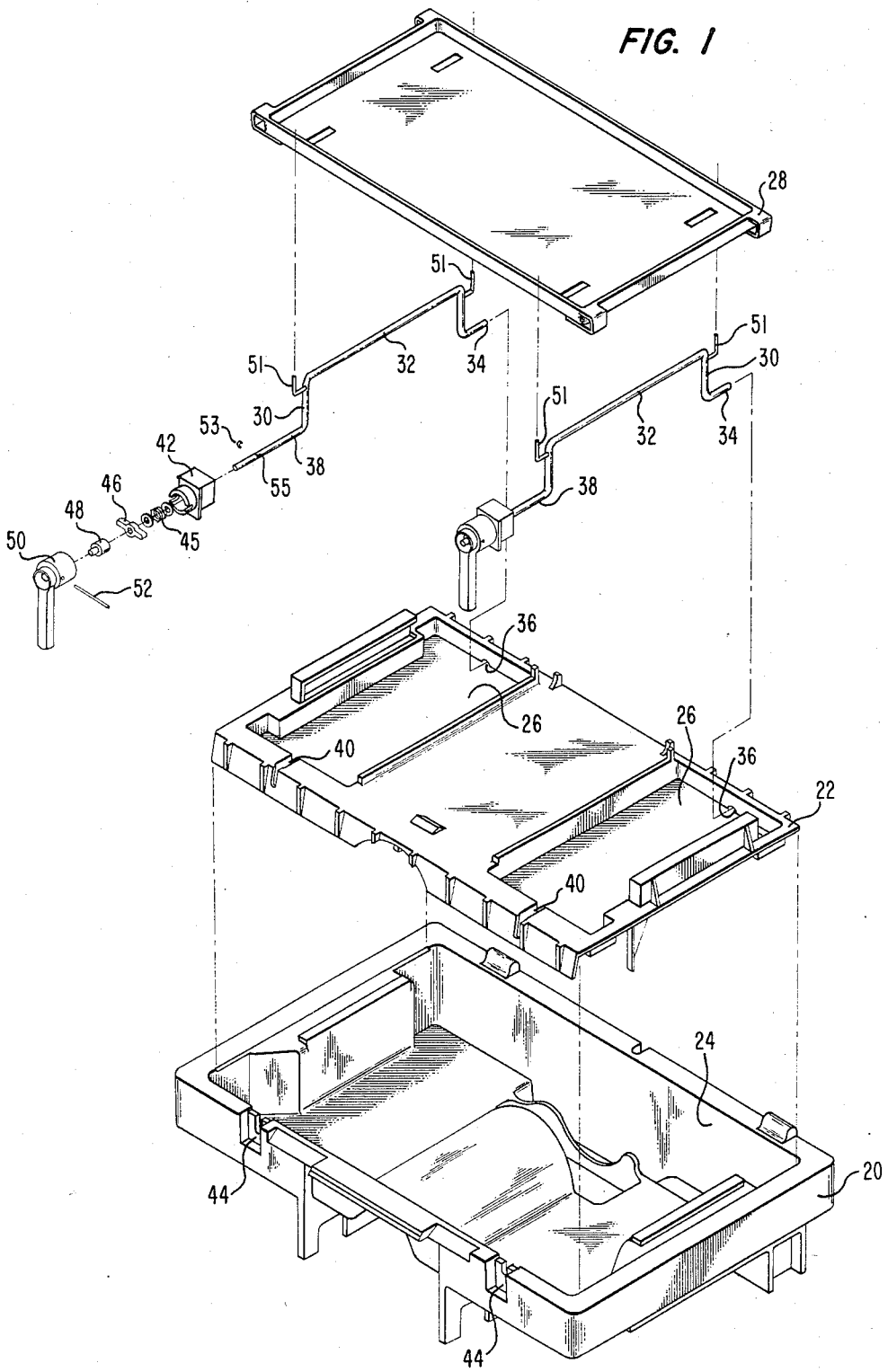
FIG. 1 is an exploded, isometric view of the tilt mechanism constructed in accordance with the present invention.

In FIG. 1, there is shown an exploded isometric view illustrating the tilt mechanism of the present invention and shows the components thereof as they would be assembled atop an infant incubator. The entire infant incubator is not shown, however it can obviously be seen that further mechanisms are utilized underneath the components viewed in FIG. 1 and an incubator hood would cover the top of the components to enclose the infant in its protected environment.

Those components of an incubator that are shown include a base 20 formed of a plastic composition and which would contain various of the functioning equipment for humidifying and heating the compartment containing the infant. On top of the base 20 is a cover 22 and which seals the infant compartment from the base 20 and also forms a part of the flow path for heated air as the incubator carries out its function. Beneath cover 22 therefore, is formed a heating and humidification compartment 24.

On the top surface of cover 22 are a pair of depressions 26, the purpose of which will become apparent.

An infant bed 28 is shown and generally lays upon the cover 22. Infant bed 28 normally carries a mattress not shown, on which the infant rests within the incubator. The infant bed 28 is therefore preferably tiltable since it is desirable, at times, to place the infant at different positions other than the horizontal position, such as with its head elevated or with its feet elevated. Accordingly, the tilt mechanism of the present invention is directed to a means of changing the tilt angle of the infant and therefore, specifically, to a means of adjusting the tilt angle of the infant bed 28 which underlies the infant.

A pair of bent rods 30 are located beneath the infant bed 28 and each have an offset portion 32 extending, in FIG. 1, upwardly toward infant bed 28. The bent rods each have one end 34 thereof that is journaled within the infant incubator, such as by suitably shaped and located recesses 36 in cover 22. The other end 38 of bent rods 30 is extended exterior to the infant incubator and that extended end 38 can readily be journaled in grooves 40 in cover 22. For purposes of further illustration, only one of the bent rods 30 of FIG. 1 will be explained, however, it should be noted that both are generally identically constructed.

Taking, therefore, the exploded view associated with the bent rod 30 in FIG. 1, there is generally shown a holder 42 through which the end 38 of bent rod 30 extends and which holder 42 forms a bearing for rotation of bent rod 30. Holder 42 can be attached to the infant incubator by being slipped over suitable shaped recesses 44 in the base 20, thus, when the bent rods 30 are extended through holders 42, the bent rods 30 themselves serve to hold the cover 22 in place upon base 20.

Fitted within holder 42 is a spring 45 which acts to exert a bias against plunger 46. An actuator means in the form of button 48 is located within a handle 50 and extends outwardly therefore so as to be readily accessible for actuation by a user. Handle 50 itself is securely fastened to the exterior end 38 of bent rod 30 by means such as a pin 52 and the entire assembly is retained in position on the exterior end 38 of bent rod 30 by means of an E-ring 53 snapped into a recess 55 in the bent rod 30.

A further detailed description of the interaction of the handle 50 will be later presented, however, for purpose of FIG. 1, it should be noted that handle 50 is affixed to the exterior end 38 of bent rod 30 and further seen that as handle 50 is rotated, the bent rod 30 also rotates to move the offset portion 32 to different radial positions. As can be seen, the offset portion 32 may, in one position, rest fully within a depression 26 and therefore have no contact with the underside of infant bed 28. Thus, in such position, the infant bed 28 would be in its lowermost position.

As handle 50 is rotated, however, the offset portion 32 also rotates and engages the bottom of infant bed 28. Further rotation causes the offset portion 32 to raise the infant bed 28 to an angular position. Infant bed 28 is stabilized during raising and when retained in a tilted in position by guides 51. At the uppermost position of offset portion 32, the infant bed 28 is obviously at its greatest angle with respect to the horizontal. At that point, the offset portion 32 is retained from further rotation in that direction by a downward projection 54 (FIG. 2) formed in the bottom of infant bed 28.

Downward projection 54 serves to prevent rotation of the bent rod 30 in the direction of the arrow 56. Just prior to encountering the downward projection 54 as the bent rod 30 moves in the direction of arrow 56, the offset portion 32 passes along the flat surface 58 of the underside of infant bed 28.

As will be seen, by utilizing the tilt mechanism of the present invention, a flat surface 58 can be present as the offset portion 32 reaches its upper most position finally encountering downward projection 54. Thus as the offset portion 32 reaches its uppermost point, and also when it returns from its uppermost point by moving in the direction opposite that of arrow 56 no abrupt or gross movements are effected to the infant bed 28, thus the movement is relatively smooth and the infant is not startled.

It should be here explained that the use of bent rods, rotated from outside the infant incubator is known in the art, however, looking in a plurality of positions is novel with the present tilt mechanism.

Figures 2, 3:
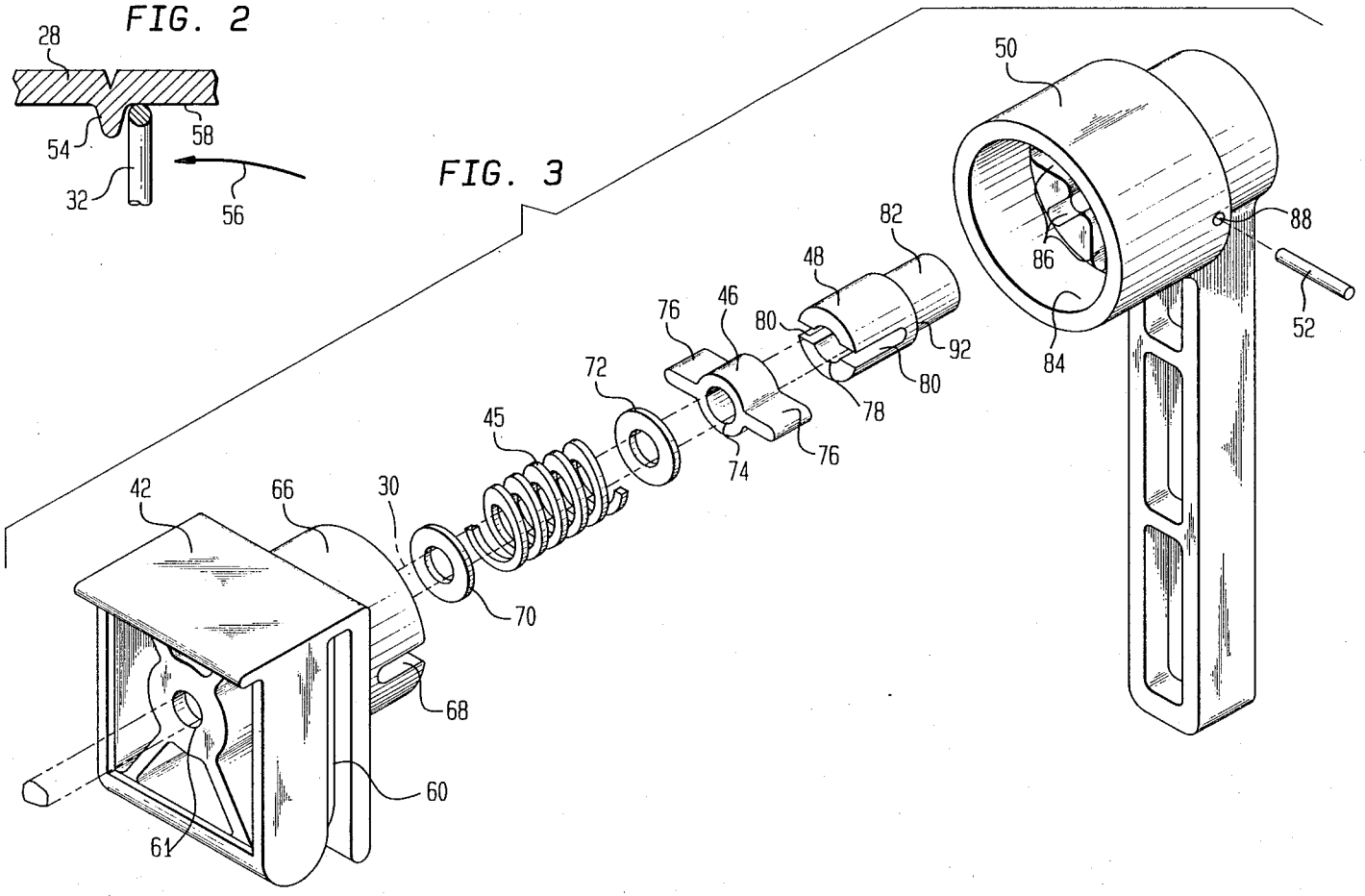
FIG. 2 is an enlarged side cross-sectional view of a part of the tilt mechanism of FIG. 1.
FIG. 3 is an exploded, isometric view of the further details of the mechanism for carrying out the subject invention.

Turning now to FIG. 3, there is shown an exploded view of the tilt mechanism of the present invention. As shown, holder 42 includes a pair of grooves 60 (only one of which is shown in FIG. 3) and which allows the holder 42 to slide into recess 44 in the base 20 as described with respect to FIG. 1.

Figure 4:
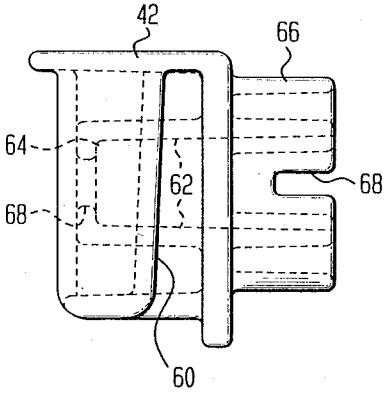
FIG. 4 is a side view, partly in section, of a component of the tilt mechanism.

Taking FIG. 4 along with FIG. 3, it can be seen that holder 42 has an opening 61 through which the exterior end 38 of bent rod 30 can be extended. A larger opening 62 is formed in holder 42 forming a shoulder 64 at the end of the holder 42 toward the interior of the incubator. A circular flange 66 projects from holder 42 and contains a pair of oppositely disposed grooves 68 (again only one is shown in FIGS. 3 and 4).

Returning to FIG. 3, the spring 45 can be seen and is surrounded by washers 70 and 72. Washer 70 fits against shoulder 64 (FIG. 4) within holder 42 to retain the spring 45 there against while washer 72 at the other end of spring 45 faces against plunger 46 to exert, as will become apparent, a spring bias against plunger 46. The plunger 46 comprises a pair of oppositely located, outwardly disposed lugs 76 and has a center aperture 74 through which the exterior end 38 of bent rod 30 freely moves, it being taken that the washers 70, 72 and spring 45 also are sufficiently sized so as to allow the exterior end 38 of bent rod 30 to pass freely therethrough.

As will be seen, the size and shape of outwardly disposed lugs 76 are such as to be slidingly fitted into grooves 68 in holder 42 to retain plunger 46 from radial movement while allowing axial movement of plunger 46 with respect to the exterior end 38 of bent rod 30.

The actuating means or button 48 abuts against plunger 46 and has an opening 78 to receive the exterior end 38 of bent rod 30 and additionally has a pair of oppositely disposed recesses 80. A reduced diameter hub 82 extends outwardly from button 48 and, when assembled, protrudes through handle 50 for access by a user.

Figure 6:
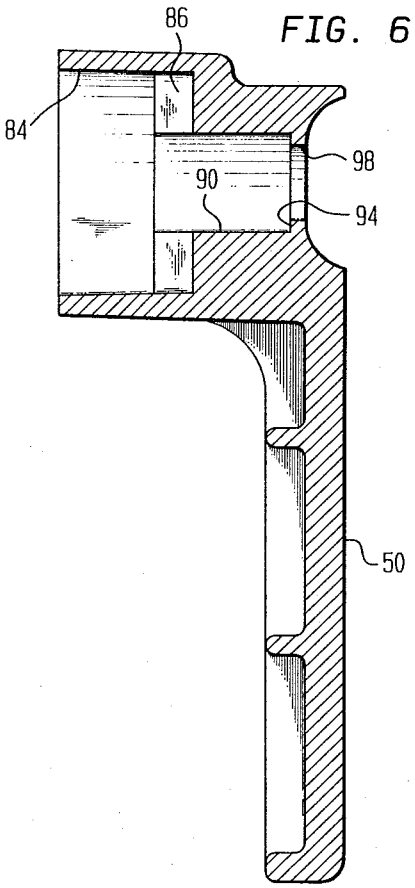
FIG. 6 is a side cross-sectional view of the handle of FIG. 5.
Figure 5:
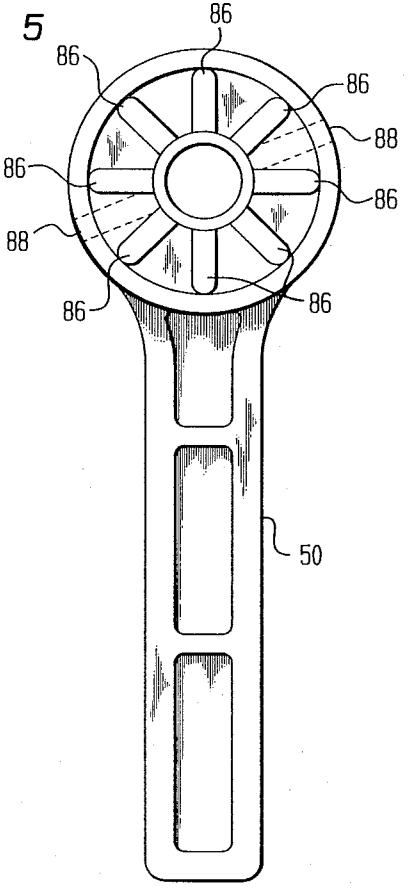
FIG. 5 is a front view of a handle used in the present invention.

Handle 50 can be described with reference to FIG. 3 and also by referring to FIGS. 5 and 6.

As shown, handle 50 has an interior opening 84 that is dimensioned so as to allow handle 50 to fit loosely about circular flange 66 of holder 42 when assembled thereto. Formed in the interior surface within interior opening 84 are a plurality of grooves 86 shown radially surrounding the center line of interior opening 84. A hole 88 is bored through handle 50 and is sized to receive the pin 52 (FIG. 1). Handle 50 also has a reduced diameter bore 90 into which the button 48 is fitted during assembly. As assembled, therefore, button 48 fits within reduced diameter bore 90 and the shoulder 92 of button 48 seats against the inside rim 94 of handle 50 as the reduced diameter bore 92 terminates within handle 50 and small opening 98 of handle 50 allows the hub 82 of button 48 to protrude outwardly to be readily available for pushing by a user.

In assembling the tilt mechanism therefore, the exterior end 38 of bent rod 30 is inserted through opening 61 in holder 42, continuing through washer 70, spring 45, washer 72, plunger 46 and ends within opening 78 within button 48. As button 48 is thus positioned within handle 50, pin 52 (FIG. 1) is inserted through hole 88 in handle 50, and proceeds through recesses 80 in button 48 and secures exterior end 38 of bent rod 30 by passing through a hole (not shown) in the exterior end 38. Thus as handle 50 is rotated, the exterior end 38 of bent rod 30 also rotates as does button 48.

Button 48 also moves axially since button 48 can slide freely with respect to pin 52 located within recesses 80 in button 48.

Finally, the entire tilt mechanism is fitted together by compressing spring 45 to some degree and securing holder 42 to the bent rod 30 by snapping E-ring 53 (FIG. 1) into recess 55. E-ring 53 thus rests against the outer surface of holder 42.

According, as assembled, the tilt mechanism of the present invention operates in the following manner. When the hub 82 of button 48 is in its fully outward position protruding thought handle 50, plunger 46 is in engagement with a pair of opposite grooves 86 in handle 50. Since plunger 46 is prevented from moving radially by its sliding engagement with grooves 68 in circular flange 66 of holder 42, the handle 50 is locked in position with respect to holder 42 and the bent rod 30 is likewise locked into whatever position it occupies.

In order to rotate bent rod 30, the hub 82 of button 48 is manually pushed inwardly by a user against the bias of spring 45. As button 48 moves against spring 45, the outwardly disposed lugs 76 of plunger 46 disengage from the particular opposite grooves 86 of handle 50 and thus handle 50 can be rotated. Plunger 46 still is prevented from rotating, however, since those outwardly disposed lugs 76 are still held against rotational movement by the sliding engagement with grooves 68 of holder 42.

Thus, the user can select the next desired rotational position of handle 50, and thus the desired angular elevation of infant bed 28 and thus release the pushing force exerted against button 48. Plunger 46 will thus re-engage the desired new set of grooves 86 in handle 50 and when aligned therewith, the spring bias exerted by spring 45 will force the outwardly disposed lugs 76 to reenter the selected grooves 86 at the desired position determined by the user.

As can thus be seen, in the event the user inadvertently lets go of the button 48 when in its depressed position as when the user were adjusting the angularly of infant bed 28, the infant bed 28 will not drop any large amount since the plunger 46 will re-engage with the next lower set of grooves 86 in the handle 50, thus the drop experienced by the infant will be slight. Also, since the angularity of the infant bed 28 is set by the tilt mechanism itself, the infant bed 28 can be set to intermediate position between fully lowered and fully raised. At the fully raised position, an enlarged depression or projection is not needed on the underside of the infant bed to hold the bent rod to that fully raised position since it is held there by the tilt mechanism itself. Thus, as explained with particular reference to FIG. 2, reaching and descending from the uppermost infant bed position can be carried out smoothly.

I claim:

1. A tilt mechanism for adjusting the angle of an infant bed adapted to underlie an infant contained within an infant incubator, said tilt mechanism comprising:

at least one bent rod having one end thereof extending to the exterior of the incubator, said at least one bent rod having an offset portion located beneath the infant bed, said offset portion adapted to move said bed upwardly and downwardly as said one end thereof is rotated;

a handle affixed to said one end of said bent rod and having a plurality of grooves formed therein;

a plunger, fixed on said rod with respect to radial movement but being axially moveable into and out of at least one of said plurality of grooves in said handle;

spring bias means to bias said plunger toward engagement into said at least one of said plurality of grooves;

actuator means adapted to be manually pushed against said spring bias to axially move said plunger out of engagement with said at least one of said plurality of grooves so that said handle can be rotated to rotate said one end of said bent rod to raise and lower said infant bed said actuator means, when said manual pushing is terminated, adapted to cause said plunger to reenter engagement with at least one of said plurality of grooves to prevent further rotation of said handle.

2. A tilt mechanism as defined in claim 1, wherein said plurality of grooves comprise a plurality of grooves radially spaced about the point of affixation of said one end of said at least one bent rod and said handle.

3. A tilt mechanism as denied in claim 1 wherein said plunger comprises a pair of outwardly disposed lugs adapted to engage oppositely disposed grooves in said handle.

4. A tilt mechanism for adjusting the angle of an infant bed adapted to underlie an infant contained within an infant incubator, said tilt mechanism comprising;

a pair of bent rods each having one end thereof extending to the exterior of the incubator, said pair of bend rods located at opposite ends of said infant bed and each having an offset portion located beneath the opposite ends of said infant bed, said offset portions adapted to move the respective end of said bed upwardly and downwardly as said one end of each of said pair of bent rods is rotated;

a pair of handles, each being affixed to said one end of both of said bent rods and each having a plurality of grooves formed radially about said bent rods;

a pair of plungers, each fixed on said rods with respect to radial movement but being axially moveable into and out of at least one of said plurality of grooves of said pair of handles;

spring bias means to bias said plungers toward engagement into said at least one of said plurality of grooves of said pair of handles;

actuator means adapted to be manually pushed against said spring bias to axially move either of said plungers out of engagement with said plurality of grooves so that each of said pair of handles can be rotated to rotate its respective bent rod to raise and lower one end of said infant bed.

* * * * *